US011299876B2

(12) United States Patent
Polly et al.

(10) Patent No.: US 11,299,876 B2
(45) Date of Patent: Apr. 12, 2022

(54) ELECTRONIC PLUMBING FIXTURE FITTING INCLUDING MEASUREMENT SYSTEM

(71) Applicant: FB Global Plumbing Group LLC, North Olmsted, OH (US)

(72) Inventors: George John Polly, Brecksville, OH (US); Christopher R. Novick, Strongsville, OH (US); Brian Patrick Frackelton, Macedonia, OH (US)

(73) Assignee: FB Global Plumbing Group LLC, North Olmsted, OH (US)

( * ) Notice: Subject to any disclaimer, the term of this patent is extended or adjusted under 35 U.S.C. 154(b) by 0 days.

(21) Appl. No.: 16/857,903

(22) Filed: Apr. 24, 2020

(65) Prior Publication Data

US 2020/0340222 A1 Oct. 29, 2020

Related U.S. Application Data

(60) Provisional application No. 62/957,714, filed on Jan. 6, 2020, provisional application No. 62/838,009, filed on Apr. 24, 2019.

(51) Int. Cl.

| | |
|---|---|
| ***F16K 11/02*** | (2006.01) |
| ***E03C 1/05*** | (2006.01) |
| ***E03C 1/04*** | (2006.01) |

(52) U.S. Cl.

CPC ..... *E03C 1/055* (2013.01); *E03C 1/0404* (2013.01)

(58) Field of Classification Search

CPC . E03C 1/055; G05D 23/1353; G05D 23/1393

See application file for complete search history.

(56) References Cited

U.S. PATENT DOCUMENTS

| | | | |
|---|---|---|---|
| 9,010,377 | B1 | 4/2015 | O'Brien et al. |
| 9,194,110 | B2 | 11/2015 | Frick et al. |
| 9,212,473 | B2 | 12/2015 | Baker et al. |
| 9,758,951 | B2 | 9/2017 | Evans et al. |
| 9,828,751 | B2 | 11/2017 | Parikh et al. |
| 9,976,290 | B2 | 5/2018 | Evans et al. |
| 10,036,149 | B2 | 7/2018 | Wallerstorfer |
| 10,081,931 | B2 | 9/2018 | Song |
| 10,274,971 | B2 | 4/2019 | Song |
| 10,392,786 | B2 | 8/2019 | Lance et al. |

(Continued)

OTHER PUBLICATIONS

International Search Report for International App. No. PCT/US2020/029820 dated Jul. 6, 2020 (2 pages).

(Continued)

*Primary Examiner* — Reinaldo Sanchez-Medina

(74) *Attorney, Agent, or Firm* — Calfee, Halter & Griswold LLP

(57) ABSTRACT

The present invention provides an electronic plumbing fixture fitting including a measurement system. The electronic plumbing fixture fitting includes a user input module. The user input module includes a mechanism to receive from the user numerical value(s) of parameter(s) for water to be delivered through a discharge outlet of the electronic plumbing fixture fitting (e.g., volume or volume and temperature) and a mechanism to deliver to the user the numerical value(s) of the parameter(s) via the water delivered through the discharge outlet of the electronic plumbing fixture fitting.

20 Claims, 12 Drawing Sheets

(56) References Cited

U.S. PATENT DOCUMENTS

| | | | | |
|---|---|---|---|---|
| 10,557,254 | B2 | 2/2020 | Song | |
| 10,698,429 | B2 * | 6/2020 | Rodenbeck | G05D 23/1353 |
| 2006/0138246 | A1 * | 6/2006 | Stowe | G05D 23/1393 236/12.12 |
| 2006/0153165 | A1 * | 7/2006 | Beachy | G01F 13/008 370/352 |
| 2006/0186215 | A1 * | 8/2006 | Logan | E03C 1/055 236/12.2 |
| 2007/0152074 | A1 * | 7/2007 | Stowe | G05D 23/1393 236/12.1 |
| 2007/0246550 | A1 * | 10/2007 | Rodenbeck | G05D 23/1353 236/12.11 |
| 2009/0039176 | A1 * | 2/2009 | Davidson | G05D 23/1393 239/67 |
| 2009/0056011 | A1 | 3/2009 | Wolf et al. | |
| 2009/0119832 | A1 * | 5/2009 | Conroy | E03C 1/05 4/623 |
| 2013/0248033 | A1 | 9/2013 | Parikh et al. | |
| 2013/0291978 | A1 | 11/2013 | Baker et al. | |
| 2016/0076233 | A1 | 3/2016 | Parikh et al. | |
| 2016/0208946 | A1 | 7/2016 | Moghe et al. | |
| 2016/0208947 | A1 | 7/2016 | Song et al. | |
| 2016/0208948 | A1 | 7/2016 | Wallerstorfer | |
| 2017/0183214 | A1 | 6/2017 | Hecht et al. | |
| 2018/0313068 | A1 | 11/2018 | Hirsch | |
| 2018/0328011 | A1 | 11/2018 | Chen | |
| 2018/0355592 | A1 * | 12/2018 | Mandel | G01F 1/661 |
| 2019/0338502 | A1 | 11/2019 | Baker et al. | |
| 2020/0123746 | A1 | 4/2020 | Frackelton | |
| 2020/0123747 | A1 | 4/2020 | Frackelton | |
| 2020/0173152 | A1 | 6/2020 | Song | |

OTHER PUBLICATIONS

Written Opinion of the International Searching Authority for International App. No. PCT/US2020/029820 dated Jul. 6, 2020 (13 pages).

* cited by examiner

ELECTRONIC PLUMBING FIXTURE FITTING INCLUDING MEASUREMENT SYSTEM

CROSS-REFERENCE TO RELATED APPLICATIONS

This application claims the benefit of U.S. Provisional Application No. 62/838,009, filed Apr. 24, 2019, and U.S. Provisional Application No. 62/957,714, filed Jan. 6, 2020, the entire disclosures of which are hereby incorporated by reference.

FIELD

The present invention relates generally to an electronic plumbing fixture fitting and, more particularly, to an electronic plumbing fixture fitting, such as an electronic faucet, including a measurement system.

BACKGROUND

Electronic plumbing fixture fittings, such as electronic faucets, are well known. Such electronic plumbing fixture fittings are used in residential and commercial applications, such as in kitchens and various other locations. Users desire to use electronic plumbing fixture fittings. Many difficulties can be encountered in using electronic plumbing fixture fittings.

SUMMARY

The present invention provides an electronic plumbing fixture fitting including a measurement system.

In an exemplary embodiment, the electronic plumbing fixture fitting comprises a discharge outlet, an electronic valve, a user input module, a flow sensor, and a processor. The discharge outlet is operable to deliver water. The electronic valve is operable to permit flow of water through the discharge outlet when the electronic valve is activated and to not permit flow of water through the discharge outlet when the electronic valve is deactivated. The electronic valve is operable to control a volume of water flowing through the discharge outlet. The user input module is operable to communicate with a user regarding a desired volume of water. The flow sensor is operable to detect a volume of water. The processor is operable to communicate with each of the electronic valve, the user input module, and the flow sensor regarding at least one of the desired volume of water and the detected volume of water. The user input module is operable to receive the desired volume of water from the user and to send a signal to the processor indicating the desired volume of water. The processor is operable to receive the signal from the user input module indicating the desired volume of water and to send a signal to the electronic valve to control the volume of water. The electronic valve is operable to receive the signal from the processor to control the volume of water. The electronic valve is operable to open and deliver water at an initial low flow rate. The flow sensor is operable to detect the volume of water and to send a signal to the processor indicating the detected volume of water. The processor is operable to receive the signal from the flow sensor indicating the detected volume of water and to send a signal to the electronic valve to further control the volume of water. The electronic valve is operable to receive the signal from the processor to further control the volume of water. The electronic valve is operable to deliver water at a final low flow rate and close once the detected volume of water is approximately equal to the desired volume of water.

In an exemplary embodiment, the electronic plumbing fixture fitting comprises a discharge outlet, an electronic valve, a user input module, a flow sensor, a temperature sensor, and a processor. The discharge outlet is operable to deliver water. The electronic valve is operable to permit flow of water through the discharge outlet when the electronic valve is activated and to not permit flow of water through the discharge outlet when the electronic valve is deactivated. The electronic valve is operable to control a volume and a temperature of water flowing through the discharge outlet. The user input module is operable to communicate with a user regarding a desired volume and a desired temperature of water. The flow sensor is operable to detect a volume of water. The temperature sensor is operable to detect a temperature of water. The processor is operable to communicate with each of the electronic valve, the user input module, the flow sensor, and the temperature sensor regarding at least one of the desired volume of water, the detected volume of water, the desired temperature of water, and the detected temperature of water. The user input module is operable to receive the desired volume and the desired temperature of water from the user and to send a signal to the processor indicating the desired volume and the desired temperature of water. The processor is operable to receive the signal from the user input module indicating the desired volume and the desired temperature of water and to send a signal to the electronic valve to control the volume and the temperature of water. The electronic valve is operable to receive the signal from the processor to control the volume and the temperature of water. The electronic valve is operable to open and deliver water. The temperature sensor is operable to detect the temperature of water and to send a signal to the processor indicating the detected temperature of water. The processor is operable to receive the signal from the temperature sensor indicating the detected temperature of water and to send a signal to the electronic valve to further control the temperature of water. The electronic valve is operable to receive the signal from the processor to further control the temperature of water. The electronic valve is operable to close once the detected temperature of water is approximately equal to the desired temperature of water. The user input module is operable to communicate with the user regarding a desired time for delivery of the desired volume of water at the desired temperature of water and to send a signal to the processor indicating the desired time for delivery of the desired volume of water at the desired temperature of water. The processor is operable to receive the signal from the user input module indicating the desired time for delivery of the desired volume of water at the desired temperature of water and to send a signal to the electronic valve to deliver the water. The electronic valve is operable to receive the signal from the processor to deliver the water. The electronic valve is operable to open and deliver the desired volume of water at the desired temperature of water. The electronic valve is operable to close once the detected volume of water is approximately equal to the desired volume of water.

In an exemplary embodiment, the electronic plumbing fixture fitting comprises a discharge outlet, an electronic valve, a user input module, a flow sensor, a temperature sensor, and a processor. The discharge outlet is operable to deliver water. The electronic valve is operable to permit flow of water through the discharge outlet when the electronic valve is activated and to not permit flow of water through the discharge outlet when the electronic valve is deactivated.

The electronic valve is operable to control a volume and a temperature of water flowing through the discharge outlet. The user input module is operable to communicate with a user regarding a desired volume and a desired temperature of water. The flow sensor is operable to detect a volume of water. The temperature sensor is operable to detect a temperature of water. The processor is operable to communicate with each of the electronic valve, the user input module, the flow sensor, and the temperature sensor regarding at least one of the desired volume of water, the detected volume of water, the desired temperature of water, and the detected temperature of water. The user input module is operable to receive the desired volume and the desired temperature of water from the user and to send a signal to the processor indicating the desired volume and the desired temperature of water. The processor is operable to receive the signal from the user input module indicating the desired volume and the desired temperature of water and to send a signal to the electronic valve to control the volume and the temperature of water. The electronic valve is operable to receive the signal from the processor to control the volume and the temperature of water. The electronic valve is operable to open and deliver water at an initial low flow rate. The flow sensor is operable to detect the volume of water and to send a signal to the processor indicating the detected volume of water. The temperature sensor is operable to detect the temperature of water and to send a signal to the processor indicating the detected temperature of water. The processor is operable to receive the signal from the flow sensor indicating the detected volume of water and the signal from the temperature sensor indicating the detected temperature of water and to send a signal to the electronic valve to further control the volume and the temperature of water. The electronic valve is operable to receive the signal from the processor to further control the volume and the temperature of water. The electronic valve is operable to deliver water at a final low flow rate and close once the detected volume of water is approximately equal to the desired volume of water.

DETAILED DESCRIPTION

The present invention provides an electronic plumbing fixture fitting. In an exemplary embodiment, the electronic plumbing fixture fitting is an electronic faucet. However, one of ordinary skill in the art will appreciate that the electronic plumbing fixture fitting could be an electronic showering system, an electronic showerhead, an electronic handheld shower, an electronic body spray, an electronic side spray, or any other electronic plumbing fixture fitting.

Figure 1:
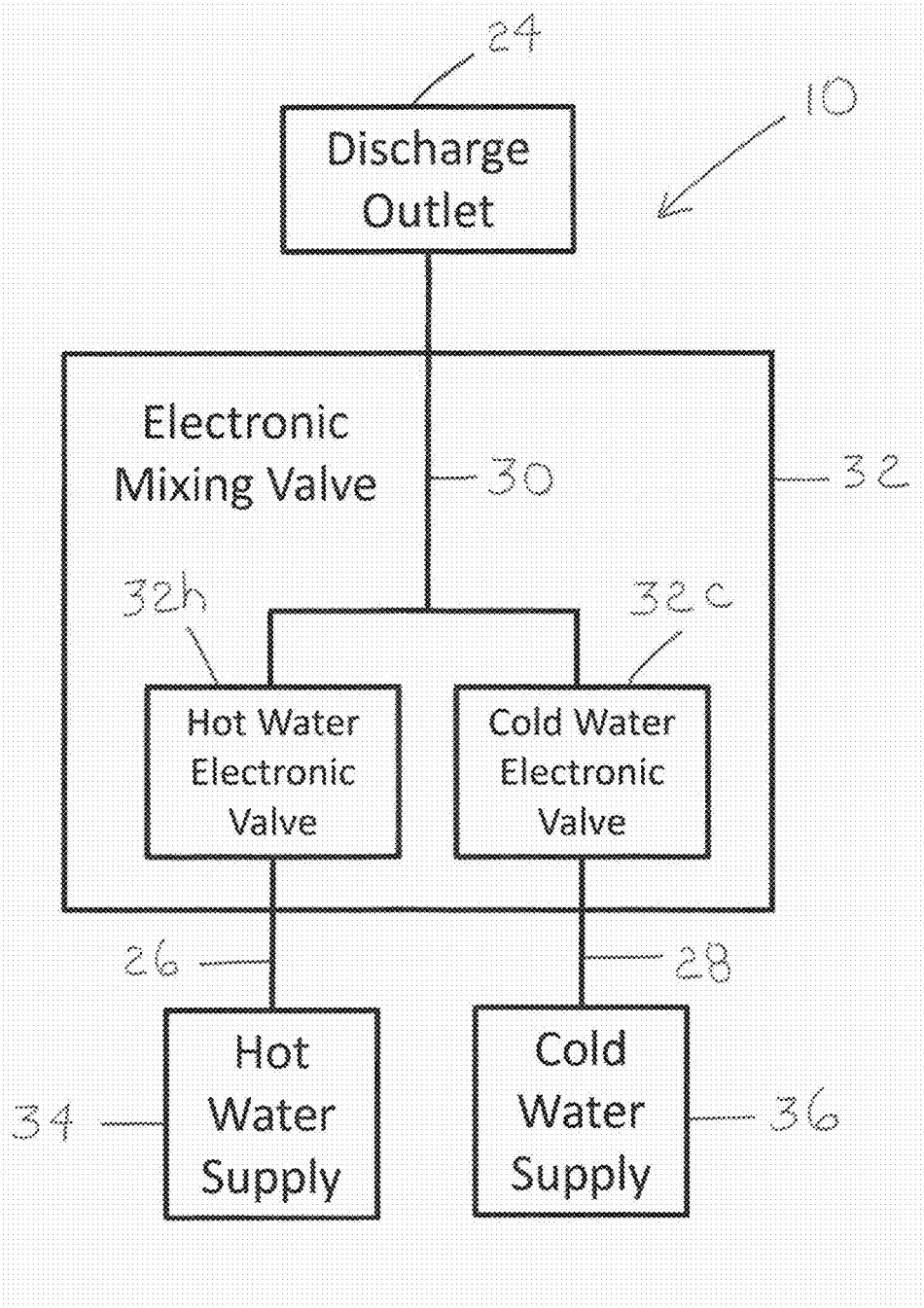
FIG. 1 is a schematic illustration of fluidic components of an electronic plumbing fixture fitting according to an exemplary embodiment of the present invention.
Figure 2:
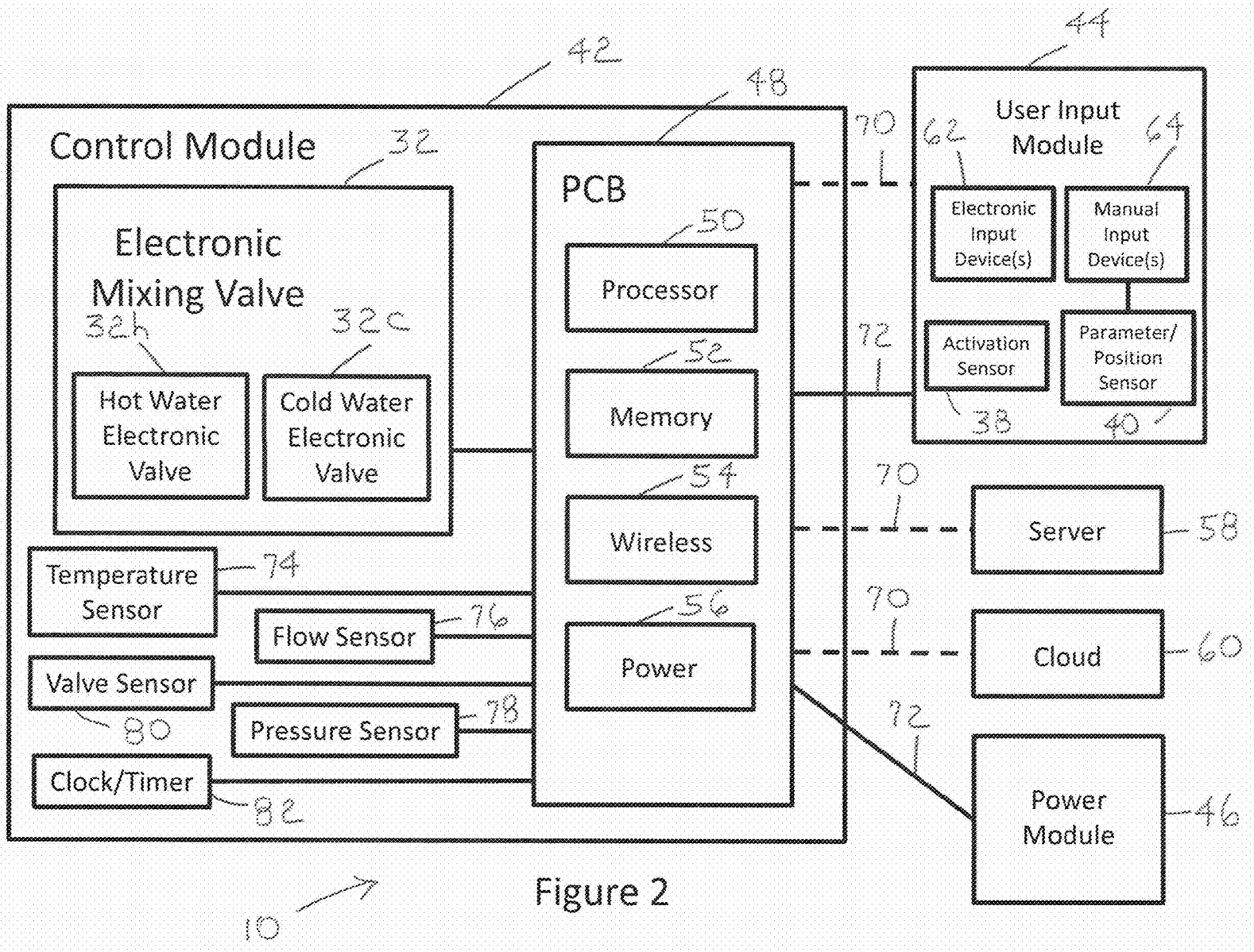
FIG. 2 is a schematic illustration of electrical/electronic components of an electronic plumbing fixture fitting according to an exemplary embodiment of the present invention.
Figure 3:
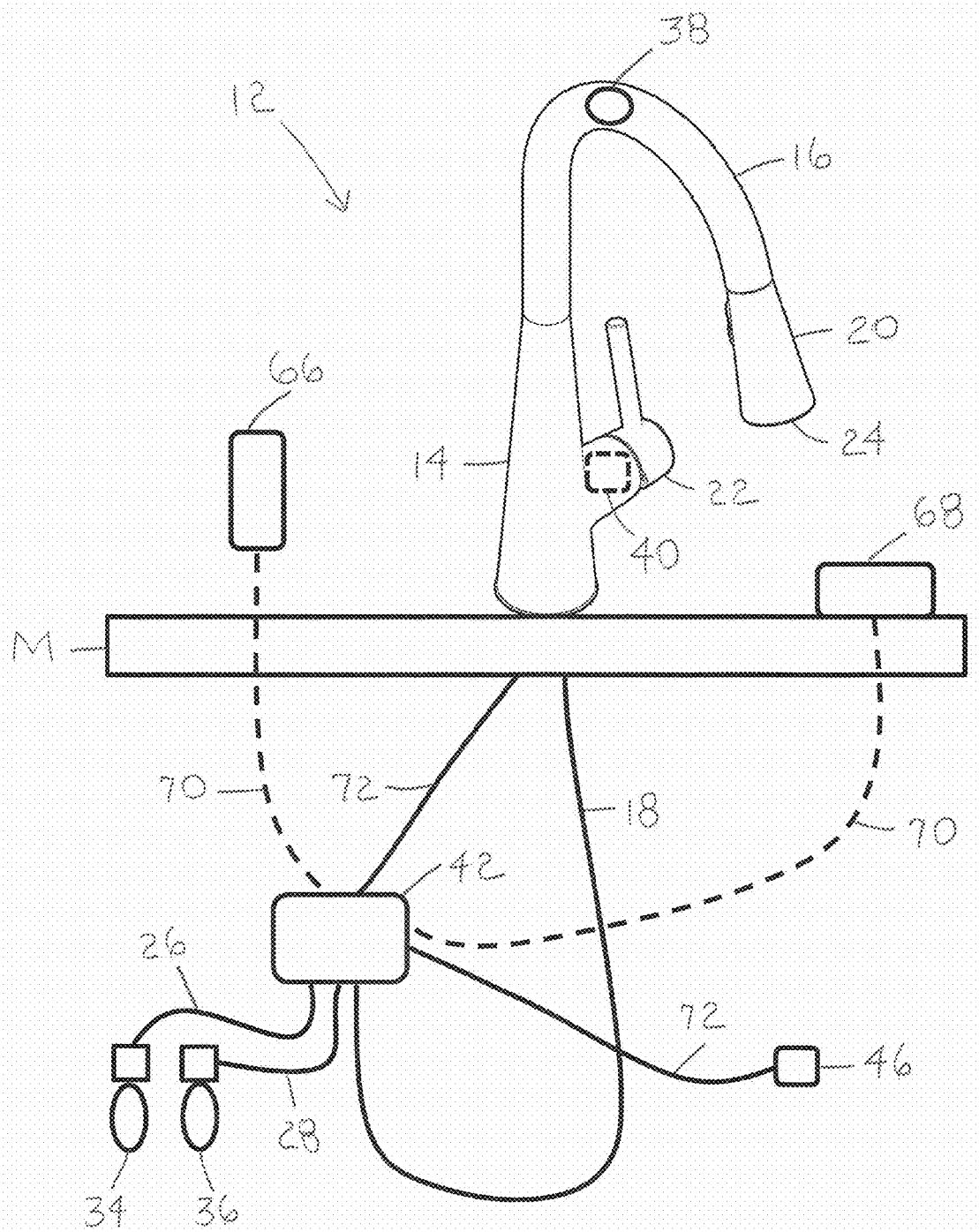
FIG. 3 is an illustration of an electronic faucet according to an exemplary embodiment of the present invention.

An exemplary embodiment of an electronic plumbing fixture fitting 10, such as an electronic faucet 12, is illustrated in FIGS. 1 and 2. FIG. 1 primarily shows the fluidic components and connections of the electronic plumbing fixture fitting 10, and FIG. 2 primarily shows the electrical/electronic components and connections of the electronic plumbing fixture fitting 10. An exemplary embodiment of the electronic faucet 12 is illustrated in FIG. 3. FIG. 3 shows the fluidic and electrical/electronic components of the electronic faucet 12.

In the illustrated embodiments, as best shown in FIG. 3, the faucet 12 includes a hub 14, a spout 16, a wand hose 18, a wand 20, and a handle 22. An upstream end of the hub 14 is connected to a mounting surface M (such as a counter or sink). An upstream end of the spout 16 is connected to a downstream end of the hub 14. The spout 16 is operable to rotate relative to the hub 14. The wand hose 18 extends through the hub 14 and the spout 16 and is operable to move within the hub 14 and the spout 16. An upstream end of the wand 20 is mounted in a downstream end of the spout 16 and is connected to a downstream end of the wand hose 18. A downstream end of the wand 20 includes a discharge outlet 24 through which water is delivered from the faucet 12. The wand 20 is operable to pull away from the spout 16. The handle 22 is connected to a side of the hub 14 and is operable to move relative to the hub 14. Although the faucet 12 has been described as having a rotatable spout 16, a pull-out or pull-down wand 20, and a handle 22 mounted on the hub 14, one of ordinary skill in the art will appreciate that, in certain embodiments, the spout 16 could be fixed relative to the hub 14, the faucet 12 may not include a wand 20, the handle 22 could be mounted on other locations on the faucet 12 or remote from the faucet 12, the faucet 12 could include more than one handle 22, the handle 22 could be any mechanical actuation device or user interface, and/or the faucet 12 may not include a handle 22.

Additionally, in the illustrated embodiments, as best shown in FIGS. 1 and 3, the fitting 10 and the faucet 12 include a hot water line 26, a cold water line 28, a mixed water line 30, and an electronic valve 32. In the illustrated embodiments, the electronic valve 32 is an electronic mixing valve that includes a hot water electronic valve 32*h* and a cold water electronic valve 32*c*.

An upstream end of the hot water line 26 connects to a hot water supply 34, and an upstream end of the cold water line 28 connects to a cold water supply 36. A downstream end of the hot water line 26 connects to the electronic valve 32, and a downstream end of the cold water line 28 connects to the electronic valve 32. More particularly, a downstream end of the hot water line 26 connects to the hot water electronic valve 32*h*, and a downstream end of the cold water line 28 connects to the cold water electronic valve 32*c*.

An upstream end of the mixed water line 30 connects to the electronic valve 32. More particularly, an upstream end of the mixed water line 30 connects to the hot water electronic valve 32*h* and the cold water electronic valve 32*c*. A downstream end of the mixed water line 30 connects to the discharge outlet 24. In the illustrated embodiments, at least a portion of the mixed water line 30 is the wand hose 18. As stated above, the downstream end of the wand hose 18 connects to the upstream end of the wand 20, and the downstream end of the wand 20 includes the discharge outlet 24 through which water is delivered from the faucet 12.

In the illustrated embodiments, each portion of the hot water line 26, the cold water line 28, and the mixed water line 30 is shown as including at least one hose, pipe, or passage. However, one of ordinary skill in the art will appreciate that each portion of the hot water line 26, the cold water line 28, and the mixed water line 30 could include more than one hose, pipe, or passage. Similarly, each portion of the hot water line 26, the cold water line 28, and the mixed water line 30 could include a combination of hose(s), pipe(s), and/or passage(s). In an exemplary embodiment, the hoses are flexible hoses. However, one of ordinary skill in the art will appreciate that other types of hoses could be used. If a portion of the hot water line 26, the cold water line 28, or the mixed water line 30 includes more than one hose, pipe, and/or passage, the hose(s), pipe(s), and/or passage(s) are connected via connectors. In an exemplary embodiment for the flexible hoses, the connectors are push-fit connectors. However, one of ordinary skill in the art will appreciate that other types of connectors could be used.

When reference is made to one component of the fitting 10 or the faucet 12 connecting to another component of the fitting 10 or the faucet 12, the connection may be direct or indirect. One of ordinary skill in the art will appreciate that additional components may be needed if the connection is indirect.

In the illustrated embodiments, the fitting 10 and the faucet 12 include the electronic valve 32 and, more particularly, the hot water electronic valve 32*h* and the cold water electronic valve 32*c*. However, one of ordinary skill in the art will appreciate that the fitting 10 and the faucet 12 could include one or more electronic valves. Additionally, the fitting 10 and the faucet 12 could include one or more mechanical valves, either in parallel or in series with the electronic valve(s). Further, although the fitting 10 and the faucet 12 have been described as including the electronic valve 32 that is an electronic mixing valve, one of ordinary skill in the art will appreciate that the fitting 10 and the faucet 12 could include just the hot water electronic valve 32*h* or just the cold water electronic valve 32*c*.

In an exemplary embodiment, the hot water electronic valve 32*h* and the cold water electronic valve 32*c* are proportional valves and, more specifically, stepper motor actuated valves. However, one of ordinary skill in the art will appreciate that the hot water electronic valve 32*h* and the cold water electronic valve 32*c* could be any type of electronic valves, including, but not limited to, solenoid valves and electronic throttle valves.

In the illustrated embodiments, as best shown in FIG. 3, the fitting 10 and the faucet 12 includes an activation sensor 38, such as a toggle sensor. In an exemplary embodiment, the activation sensor 38 is a proximity sensor and, in particular, an infrared sensor. The activation sensor 38 is also referred to as a latching sensor and a sustained-flow sensor. In the illustrated embodiment, the activation sensor 38 is mounted on an apex of the spout 16. The activation sensor 38 defines an activation zone. In an exemplary embodiment, the activation sensor 38 is operable to activate the hot water electronic valve 32*h* and the cold water electronic valve 32*c* when an object enters the activation zone and to deactivate the hot water electronic valve 32*h* and the cold water electronic valve 32*c* when the object exits and reenters the activation zone. As used herein, an "object" can be any portion of a user's body or any item used by the user to trigger the activation sensor 38. In an exemplary embodiment, the activation zone extends generally upwardly from the activation sensor 38. Additionally, in an exemplary embodiment, the activation zone has a generally cone-like shape.

As described above, the activation sensor 38 is a proximity sensor and, in particular, an infrared sensor. Proximity sensors are sensors that detect the presence of an object without any physical contact. However, one of ordinary skill in the art will appreciate that the activation sensor 38 could be any type of electronic sensor that can be triggered, including, but not limited to, other proximity sensors, touch sensors, and image sensors. Exemplary electronic sensors include, but are not limited to, electromagnetic radiation sensors (such as optical sensors and radar sensors), capacitance sensors, inductance sensors, piezo-electric sensors, and multi-pixel optical sensors (such as camera sensors). As further described above, the activation sensor 38 is mounted on the apex of the spout 16. However, one of ordinary skill in the art will appreciate that the activation sensor 38 could be mounted in any location on the faucet 12 or in a location remote from the faucet 12.

Similarly, as described above, the activation sensor 38 is a toggle sensor. However, one of ordinary skill in the art will appreciate that the activation sensor 38 could be any type of sensor that provides information useful in determining whether to activate or deactivate the hot water electronic valve 32*h* and the cold water electronic valve 32*c*, including, but not limited to, flow sensors, pressure sensors, temperature sensors, and position sensors.

In the illustrated embodiments, the handle 22 operates as it would with a standard faucet. In other words, the handle 22 can be moved between various positions to indicate a desired temperature, flow rate, and/or volume of water discharged from the faucet 12.

In the illustrated embodiments, as best shown in FIG. 3, although the handle 22 does not control a mechanical valve, the handle 22 operates as it would with a standard faucet. In other words, the handle 22 can be moved between various positions to indicate a desired temperature, flow rate, and/or volume of water discharged from the faucet 12.

More specifically, with regard to the temperature of water, the handle 22 can be rotated about a longitudinal axis of a side opening in the hub 14. At one extent of a range of rotation, the position of the handle 22 indicates all hot water (a full hot position). At the other extent of the range of rotation, the position of the handle 22 indicates all cold water (a full cold position). In between the extents of the range of rotation, the position of the handle 22 indicates a mix of hot and cold water (mixed temperature positions) with hotter temperature water as the position nears the full hot extent of the range of rotation and colder temperature water as the position nears the full cold extent of the range of rotation.

With regard to the flow rate/volume of water, the handle 22 can be moved toward and away from the side opening in the hub 14. At one extent of a range of movement, the position of the handle 22 indicates no flow rate/volume of water (a full closed position). At the other extent of the range of movement, the position of the handle 22 indicates full flow rate/volume of water (a full open position). In between the extents of the range of movement, the position of the handle 22 indicates an intermediate flow rate/volume of water (less than full open positions) with reduced flow rate/volume of water as the position nears the full closed extent of the range of movement and increased flow rate/volume of water as the position nears the full open extent of the range of movement.

In an exemplary embodiment, the faucet 12 is operable to detect movement of the handle 22 and to provide information to set at least one parameter of water flowing through the hot water electronic valve 32*h* and the cold water electronic valve 32*c* based on the movement of the handle 22. The faucet 12 is operable to detect movement of the handle 22 either directly or indirectly. In an exemplary embodiment, based on the movement of the handle 22, the faucet 12 provides information to set a temperature, flow rate, and/or volume of water flowing through the hot water electronic valve 32*h* and the cold water electronic valve 32*c*.

Further, in the illustrated embodiments, as best shown in FIG. 3, the faucet 12 includes a parameter or position sensor 40. In an exemplary embodiment, the parameter or position sensor 40 is operable to detect a state of the handle 22, such as a position or a movement of the handle 22, and to provide information to set at least one parameter of water flowing through the hot water electronic valve 32*h* and the cold water electronic valve 32*c* based on the state of the handle 22, such as the position or the movement of the handle 22. The parameter or position sensor 40 is operable to detect the state of the handle 22, such as the position or the movement of the handle 22, ranging from the full hot position through the full cold position and from the full closed position through the full open position. The parameter or position sensor 40 is operable to detect the state of the handle 22, such as the position or the movement of the handle 22, either directly or indirectly. In an exemplary embodiment, based on the state of the handle 22, such as the position or the movement of the handle 22, the parameter or position sensor 40 provides information to set a temperature, flow rate, and/or volume of water flowing through the hot water electronic valve 32*h* and the cold water electronic valve 32*c*.

An electronic plumbing fixture fitting, such as an electronic faucet, including a parameter or position sensor that is operable to detect movement of a handle and to provide information to set at least one parameter (such as a temperature and/or a volume) of water flowing through a hot water electronic valve and a cold water electronic valve based on movement of the handle is disclosed in U.S. Pat. No. 9,212,473, assigned to FB Global Plumbing Group LLC, the entire disclosure of which is hereby incorporated by reference.

Further, in the illustrated embodiments, as best shown in FIGS. 2 and 3, the fitting 10 and the faucet 12 include a control module 42, a user input module 44, and a power module 46.

The flow components of the control module 42 include a number of inlets and outlets and a number of flow passages. These inlets/outlets and flow passages enable the easy management of the flow between the incoming flows (i.e., the hot water line 26 and the cold water line 28) and the outgoing flow (i.e., the mixed water line 30 or the wand hose 18).

In the illustrated embodiments, as best shown in FIG. 3, the control module 42 is operable to mount below the mounting surface M (such as the counter or sink). In an exemplary embodiment, the control module 42 is operable to mount on a mounting shank of the fitting 10 or the faucet 12. In the illustrated embodiments, the electronic valve 32 is located inside the control module 42. In the illustrated embodiments, the control module 42 includes a top or first side and a bottom or second side. The first side is opposite the second side. In the illustrated embodiments, the second side includes openings for hoses and flow passages.

In the illustrated embodiments, as best shown in FIG. 2, the control module 42 further includes a number of electronic components. These components enable the operation of the fitting 10 or the faucet 12. More specifically, these components enable the activation, deactivation, and control of the electronic valve 32 through user input. The control module 42 includes the electronic valve 32 and a printed circuit board ("PCB") 48. In the illustrated embodiments, a number of electronic components are mounted on the PCB 48, including, but not limited to, a processor 50, memory 52, a wireless communication chip 54, and a power port 56. The processor 50 receives signals from and sends signals to the components of the fitting 10 or the faucet 12 to control operation of the fitting 10 or the faucet 12. For example, the processor 50 receives signals from sensors (described above and to be described in greater detail below) and sends signals to the electronic valve 32 to activate, deactivate, and control the electronic valve 32. The memory 52 can save information received from the components of the fitting 10 or the faucet 12. The information can also be saved in remote memory. Exemplary storage locations for the remote memory include the user input module 44 (where the user input module 44 includes memory, such as an Apple iPhone and a Google Android phone), a centralized server provided by the fitting/faucet manufacturer, and a cloud service provided by the fitting/faucet manufacturer or a third party (such as Google, HomeKit, and IFTTT). In the illustrated embodiments, the remote memory includes a server 58 and a cloud 60.

In the illustrated embodiments, as best shown in FIGS. 2 and 3, the user input module 44 provides operational instructions to the electronic components of the fitting 10 or the faucet 12. The user input module 44 can be any module that enables user input. The user input module 44 includes electronic input device(s) 62 and manual input device(s) 64. Exemplary electronic input devices 62 include activation sensors, mobile devices, voice controlled devices, touch screen devices, and push button devices. In the illustrated embodiments, the user input module 44 includes the activation sensor 38, a mobile device 66, and a voice controlled device 68. Exemplary manual input devices 64 include handles and joysticks. In the illustrated embodiments, the user input module 44 includes the handle 22. The user input module 44 receives input from a user and sends signals to the control module 42 or other electronic components of the fitting 10 or the faucet 12 to control operation of the components of the fitting 10 or the faucet 12. For example, the user input module 44 receives input from a user and sends signals to the processor 50 to activate, deactivate, and control the electronic valve 32.

In the illustrated embodiments, some components of the user input module 44 (e.g., the mobile device 66 and the voice controlled device 68) are connected to the control module 42 via a wireless communication connection 70 (such as a Wi-Fi connection), while other components of the user input module 44 (e.g., the activation sensor 38 and the parameter or position sensor 40) are connected to the control module 42 via a hard-wired connection 72. In the illustrated embodiments, some components of the user input module 44 (e.g., the mobile device 66 and the voice controlled device 68) send the signals to and/or receive signals from the processor 50 via the wireless communication connection 70 (such as the Wi-Fi connection), while other components of the user input module 44 (e.g., the activation sensor 38 and the parameter or position sensor 40) send signals to and/or receive signals from the processor 50 via the hard-wired connection 72. However, one of ordinary skill in the art will appreciate that each component of the user input module 44 could be connected to the control module 42 and send signals to and/or receive signals from the processor 50 via any type of connection, including other wireless communication connections, such as Bluetooth, cellular, near field communication (NFC), Zigbee, and Z-Wave, or a hard-wired connection.

In the illustrated embodiments, as best shown in FIG. 3, three electronic input devices 62 and one manual input device 64 are shown, i.e., the activation sensor 38 on the faucet 12, the mobile device 66 that can be held or moved by the user, the voice controlled device 68 located on the mounting surface M, and the handle 22 connected to the hub 14 of the faucet 12 located on the mounting surface M. However, one of ordinary skill in the art will appreciate that the user input module 44 could include any number of components. Moreover, each component of the user input module 44 could be in any location where it can send signals to and/or receive signals from the control module 42 and/or other electronic components of the fitting 10 or the faucet 12, such as the processor 50, or each component of the user input module 44 could be integrally formed with or physically connected to the fitting 10 or the faucet 12.

In the illustrated embodiments, as best shown in FIGS. 2 and 3, the server 58 and the cloud 60 are connected to the control module 42 via the wireless communication connection 70 (such as the Wi-Fi connection).

In the illustrated embodiments, as best shown in FIGS. 2 and 3, the power module 46 provides power to the electrical/electronic components of the fitting 10 or the faucet 12. In the illustrated embodiments, the power module 46 is operable to mount below the mounting surface M. In the illustrated embodiments, the power module 46 is connected to the control module 42 via the hard-wired connection 72. In an exemplary embodiment, the power module 46 includes battery power. In an exemplary embodiment, the power module 46 includes AC power.

During operation of the electronic valve 32, the user activates, deactivates, and controls the electronic valve 32 using the user input module 44. When the user appropriately triggers the user input module 44, the electronic valve 32 is activated, deactivated, or otherwise controlled. For example, the user could trigger the user input module 44 by triggering the activation sensor 38, pressing an appropriate button on the mobile device 66, stating specific commands to the voice controlled device 68, and/or opening, closing, and/or moving the handle 22. For voice control, when the user says "turn on the faucet," the electronic valve 32 is activated. Similarly, when the user says "turn off the faucet," the electronic valve 32 is deactivated. Further, when the user says "increase temperature," "decrease temperature," "increase flow," or "decrease flow," the electronic valve 32 is controlled to accomplish the requested action. The commands can be predetermined. Additionally, the commands can be customizable. For example, the user could activate the electronic valve 32 by saying "start flow" instead of "turn on the faucet." Similarly, the user could deactivate the electronic valve 32 by saying "stop flow" instead of "turn off the faucet."

As used herein, "activate a valve" means to move the valve to or maintain the valve in an open position, regardless of the volume or temperature of the flowing water, and "deactivate a valve" means to move the valve to a completely closed position.

When reference is made to activating or deactivating the electronic valve 32 "when the user appropriately triggers the user input module 44," the electronic valve 32 may be activated or deactivated immediately upon the user input module 44 being triggered or a predetermined period of time after the user input module 44 has been triggered.

In the illustrated embodiments, the fitting 10 and the faucet 12 include sensors. In the illustrated embodiments, the sensors include the activation sensor 38, the parameter or position sensor 40, a temperature sensor 74, a flow sensor 76, a pressure sensor 78, and a valve sensor 80. The activation sensor 38 and the parameter or position sensor 40 were described above. The temperature sensor 74 is operable to detect a temperature of water in the hot water line 26, the cold water line 28, the electronic valve 32, and/or the mixed water line 30 or wand hose 18. The flow sensor 76 is operable to detect a flow rate of water in the hot water line 26, the cold water line 28, the electronic valve 32, and/or the mixed water line 30 or wand hose 18. The pressure sensor 78 is operable to detect a pressure of water in the hot water line 26, the cold water line 28, the electronic valve 32, and/or the mixed water line 30 or wand hose 18. The valve sensor 80 is operable to detect a position of the electronic valve 32 and/or a motor driving the electronic valve 32. The sensors send signals to the processor 50 indicating the detected information.

The information detected by the sensors is used to control the operation of the fitting 10 or the faucet 12. The information detected by the activation sensor 38 can be used to activate and deactivate the fitting 10 or the faucet 12. The information detected by the parameter or position sensor 40 can be used to determine a temperature, flow rate, and/or volume of water desired by the user. The information detected by the temperature sensor 74 can be used to maintain a temperature of water discharged from the fitting 10 or the faucet 12. The information detected by the flow sensor 76 can be used to determine if there is flow or maintain a flow rate of water discharged from the fitting 10 or the faucet 12. The information detected by the pressure sensor 78 can be used to maintain a pressure or determine a volume of water discharged from the fitting 10 or the faucet 12. The information detected by the valve sensor 80 can be used to open and close the electronic valve 32.

In the illustrated embodiments, the fitting 10 and the faucet 12 include a clock/timer 82. The clock/timer 82 is operable to provide a date and a time of an action or to measure time intervals. For example, the clock/timer 82 can provide a date and a time of an activation or a deactivation of the fitting 10 or the faucet 12 or measure a time interval from an activation of the fitting 10 or the faucet 12 through a deactivation of the fitting 10 or the faucet 12.

Measurement System

In an exemplary embodiment, the fitting 10 or the faucet 12 includes a measurement system. In an exemplary embodiment, the user input module 44 includes a mechanism to receive from the user numerical value(s) of parameter(s) for the water to be delivered through the discharge outlet 24 of the fitting 10 or the faucet 12 (e.g., volume or volume and temperature) and a mechanism to deliver to the user the numerical value(s) of the parameter(s) via the water delivered through the discharge outlet 24 of the fitting 10 or the faucet 12.

Generally, in an exemplary embodiment where the user input module 44 receives from the user a desired volume of water to be delivered through the discharge outlet 24 of the fitting 10 or the faucet 12, the user input module 44 sends a signal to the processor 50 indicating the desired volume. The processor 50 receives the signal from the user input module 44 and sends a signal to the electronic valve 32 to activate. As a result, water will be delivered through the discharge outlet 24 of the fitting 10 or the faucet 12. The flow sensor 76 detects the volume of the water being delivered and sends a signal to the processor 50 indicating the detected volume.

The processor 50 receives the signal from the flow sensor 76 and sends a signal to the electronic valve 32 to deactivate once the detected volume is approximately the same as the desired volume.

Generally, in an exemplary embodiment where the user input module 44 receives from the user a desired numerical value of the temperature of water to be delivered through the discharge outlet 24 of the fitting 10 or the faucet 12, the user input module 44 sends a signal to the processor 50 indicating the desired temperature. The processor 50 receives the signal from the user input module 44 and sends a signal to the electronic valve 32 to activate. As a result, water will be delivered through the discharge outlet 24 of the fitting 10 or the faucet 12. The temperature sensor 74 detects the temperature of the water being delivered and sends a signal to the processor 50 indicating the detected temperature. The processor 50 receives the signal from the temperature sensor 74. If the detected temperature is not approximately the same as the desired temperature, the processor 50 sends a signal to the electronic valve 32 to control the temperature of the water being delivered (e.g., decrease or increase the temperature based on whether the detected temperature is above or below the desired temperature). Additionally, if the detected temperature is not approximately the same as the desired temperature, the temperature sensor 74 continues to detect the temperature of the water being delivered and send signals to the processor 50 indicating the detected temperatures, and the processor 50 continues to receive the signals from the temperature sensor 74 and send signals to the electronic valve 32 to control the temperature of the water being delivered, until the detected temperature is approximately the same as the desired temperature.

In an exemplary embodiment, the measurement system includes a water flow ramp up and ramp down feature to improve accuracy and user experience. More specifically, this feature reduces error from components of the system, enables the user to position (and reposition, if necessary) the vessel into which the water is being delivered under the water flow, and reduces splashing if the vessel is small.

In an exemplary embodiment, the water flow ramp up and ramp down feature includes an initial low flow rate after the electronic valve 32 opens and a final low flow rate before the electronic valve 32 closes. Additionally, in an exemplary embodiment, this feature includes a variable water flow rate after the initial low flow rate and before the final low flow rate. Further, in an exemplary embodiment, after the electronic valve 32 opens, the water flow rate slowly ramps up to the full flow rate and, before the electronic valve 32 closes, the water flow rate slowly ramps down from the full flow rate.

In an exemplary embodiment, the flow rate ramps up in five stages, and the flow rate ramps down in five stages. However, one of ordinary skill in the art will appreciate that the flow rate could ramp up in more or less than five stages, the flow rate could ramp down in more or less than five stages, and the number of ramp up stages could be different than the number of ramp down stages.

In an exemplary embodiment, the flow rate ramps up at a linear rate, and the flow rate ramps down at a linear rate. However, one of ordinary skill in the art will appreciate that the flow rate could ramp up at a non-linear rate, the flow rate could ramp down at a non-linear rate, and the rate of the ramp up could be different than the rate of the ramp down.

In an exemplary embodiment, the time at which the flow rate starts to ramp down is calculated based, at least in part, on the time needed for the electronic valve 32 to close or the volume of water that is delivered while the electronic valve 32 is closing. In other words, the time at which the flow rate starts to ramp down is approximately equal to the total time required to deliver the desired volume of water minus the time required to close the electronic valve 32. In still other words, the volume at which the flow rate starts to ramp down is approximately equal to the desired volume of water minus the volume of water delivered while the electronic valve 32 is closing. This time or volume at which the flow rate starts to ramp down is a factor of the flow rate and the pressure at which the water is delivered.

In an exemplary embodiment, when the volume of water to be delivered is small enough, the flow rate may never reach the full flow rate.

In an exemplary embodiment, when the volume of water is to be delivered at a specified temperature, the cold water electronic valve 32*c* is opened prior to the hot water electronic valve 32*h*, and the hot water electronic valve 32*h* is closed prior to the cold water electronic valve 32*c*.

In an exemplary embodiment, when the volume of water is to be delivered at a specified temperature, control of the temperature of the water being delivered is stopped at approximately the same time as the flow rate ramp down is started.

In an exemplary embodiment, when the volume of water is to be delivered at a specified temperature, water is delivered until the flow of water reaches approximately the specified temperature. Once the flow of water reaches approximately the specified temperature, the flow of water is stopped and the user is required to trigger the activation sensor 38 in order to deliver the desired volume of water. Once the user triggers the activation sensor 38, the fitting 10 or the faucet 12 delivers the desired volume of water. As a result, the desired volume of water is delivered at approximately the specified temperature.

Exemplary Embodiments for Inputting Data to Measurement System

Figure 4A:
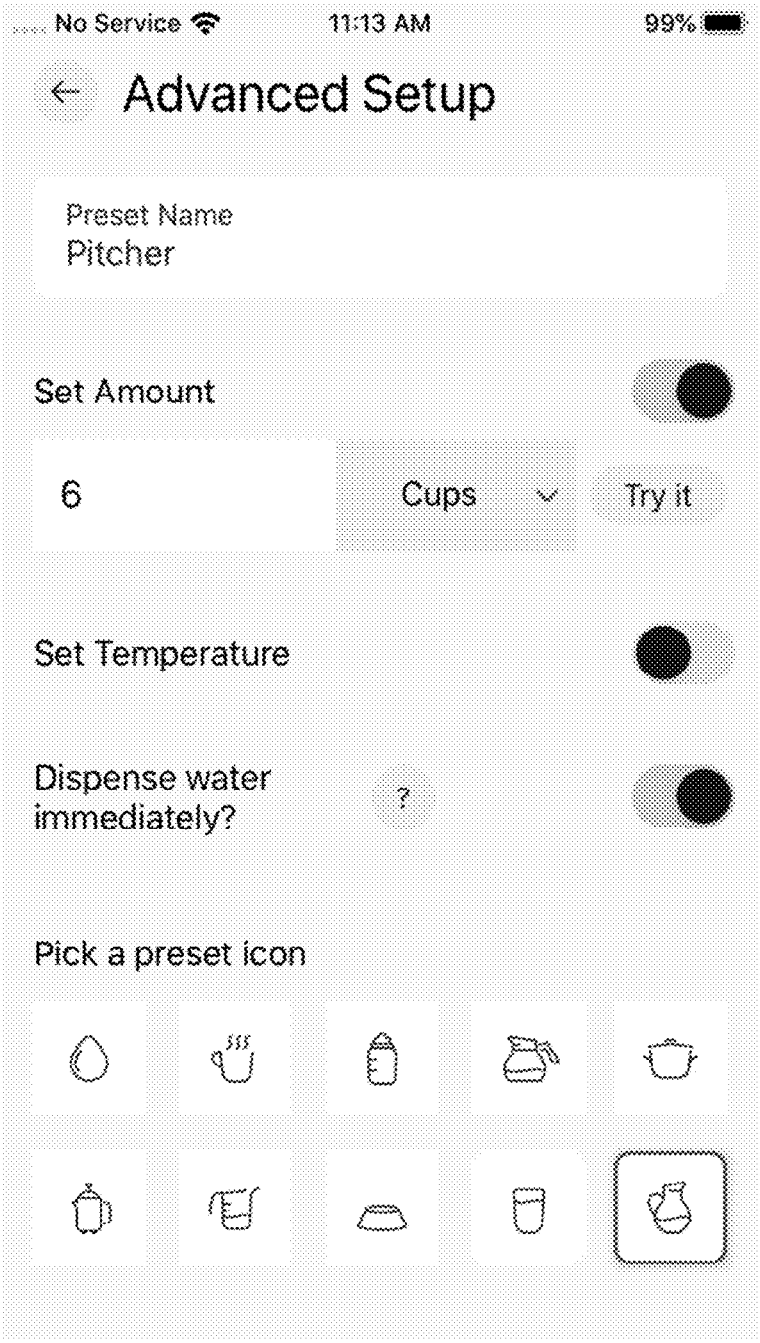
FIGS. 4*a*, 5*a*, 6*a*, 7*a*, and 8*a* are illustrations of a mobile device displaying information relating to a measurement system of an electronic plumbing fixture fitting according to an exemplary embodiment of the present invention.
Figure 6A:
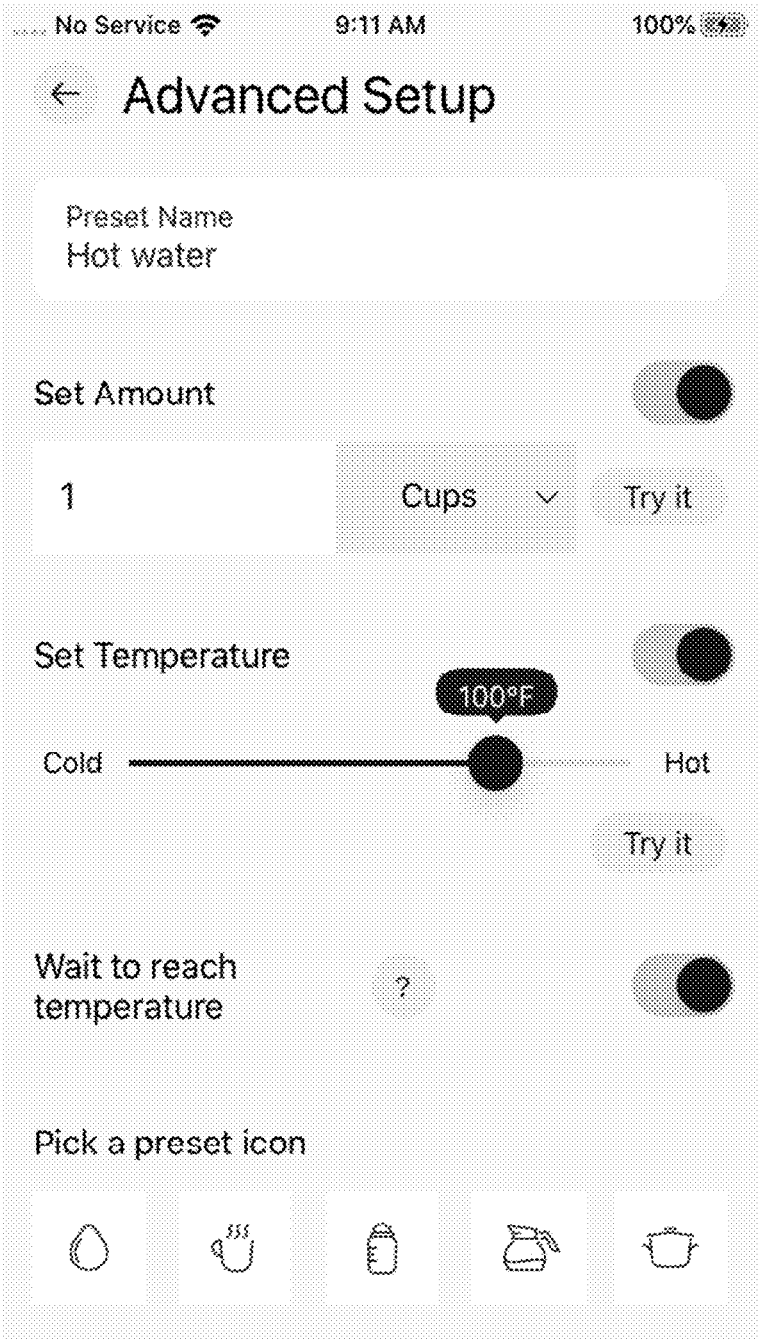
Figure 8A:
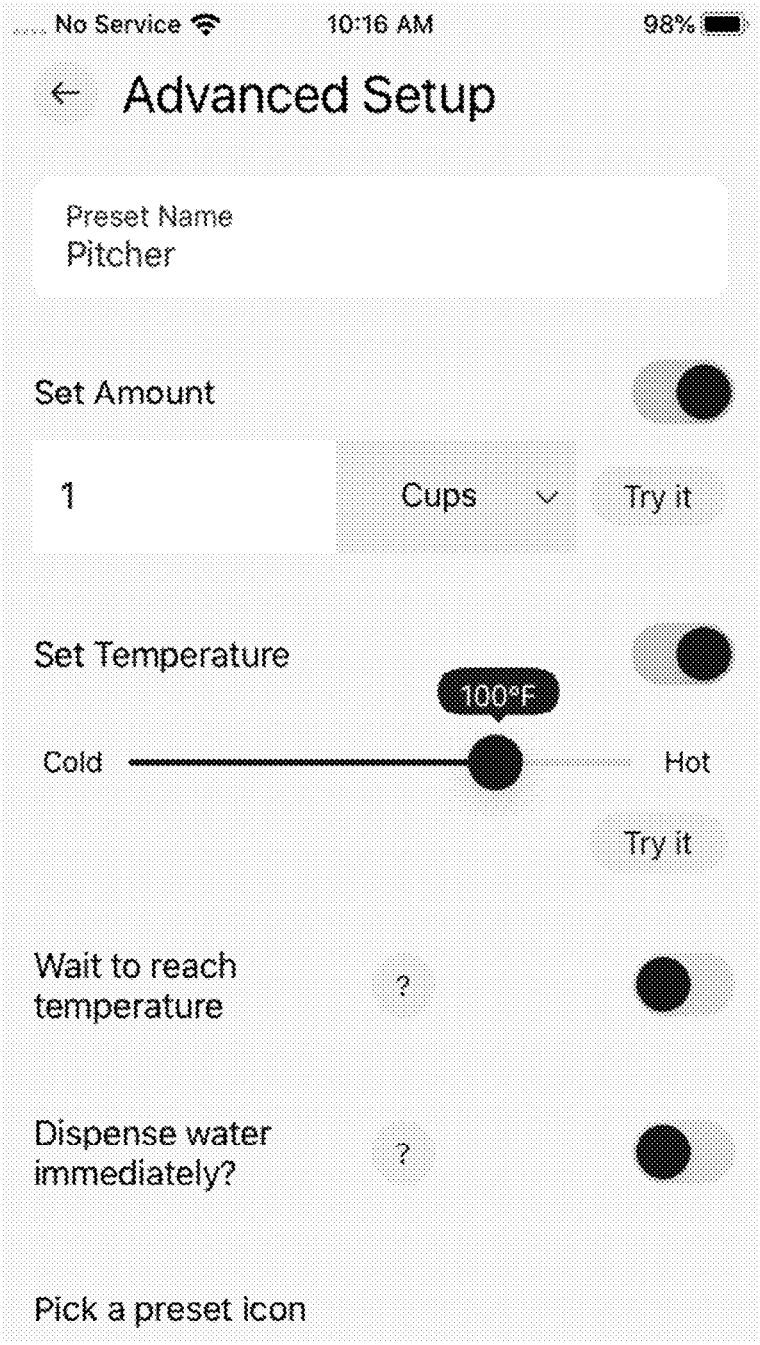

In exemplary embodiments, the user input module 44 displays parameter(s) and option(s) with corresponding field(s) for the user to input the numerical value(s) and select the option(s) (see FIGS. 4*a*, 6*a*, and 8*a*). As shown in FIGS. 4*a*, 6*a*, and 8*a*, an option is selected if the dot next to the option is to the right in the corresponding input field and is not selected if the dot next to the option is to the left in the corresponding input field. The numerical value(s) and option(s) can be saved as a preset. A preset is saved numerical value(s) of parameter(s) and selection(s) of option(s) for water to be delivered through the discharge outlet 24 of the fitting 10 or the faucet 12. The user input module 44 enables the user to create and select presets. The user input module also enables the user to name presets.

Embodiment 1—Measured Volume—Default Temperature

In an exemplary embodiment for delivering a volume of water at a default temperature, the user input module 44 receives from the user a desired numerical value of the volume of water to be delivered through the discharge outlet 24 of the fitting 10 or the faucet 12. The user can input the desired numerical value of the volume of water to be delivered by selecting a previously saved preset or by entering the desired numerical value via a voice command or another input device. The user input module 44 sends a signal to the processor 50 indicating the desired volume. The processor 50 receives the signal from the user input module 44.

In an exemplary embodiment, if the user input module 44 does not receive from the user a desired numerical value of the temperature at which the water should be delivered through the discharge outlet 24 of the fitting 10 or the faucet 12, the default temperature is the coldest temperature possible. However, one of ordinary skill in the art will appreciate that the default temperature could be a mid-mix temperature, the hottest temperature possible, or any other temperature.

FIG. 4*a* shows an exemplary screen displayed by the user input module 44 (i.e., the mobile device 66) where the user is creating a preset with a desired numerical value of the volume, but not a desired numerical value of the temperature.

Figure 4B:
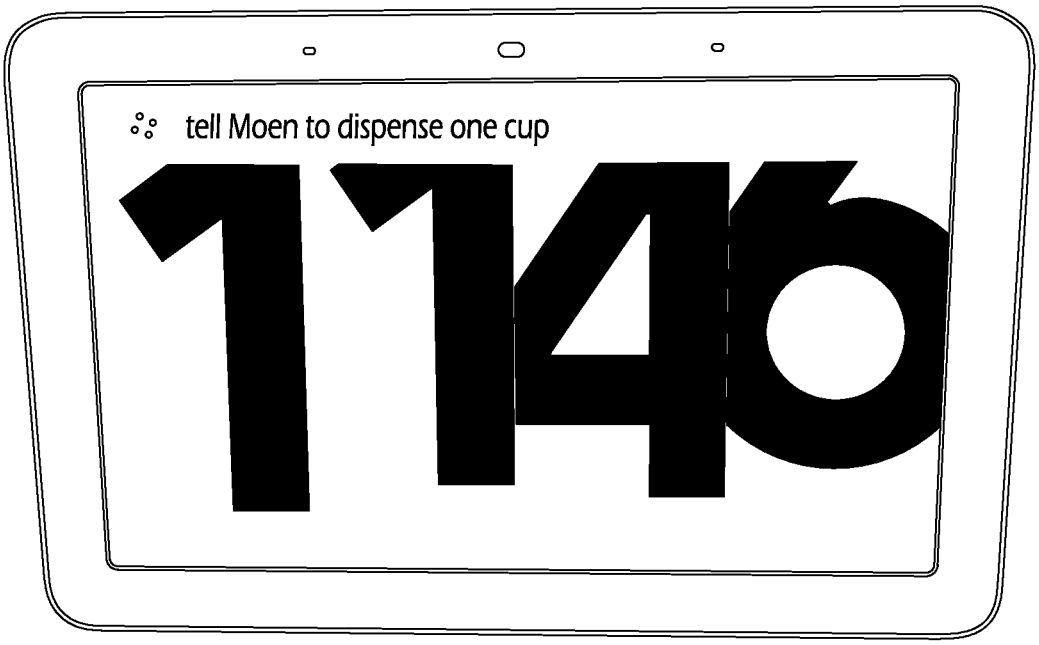
FIGS. 4*b*, 5*b*, 6*b*, and 7*b* are illustrations of a voice controlled device displaying information relating to a measurement system of an electronic plumbing fixture fitting according to an exemplary embodiment of the present invention.

FIG. 4*b* shows an exemplary screen displayed by the user input module 44 (i.e., the voice controlled device 68) where the user has provided a desired numerical value of the volume, but not a desired numerical value of the temperature (the time of day is displayed with the desired numerical value of the volume).

In the exemplary embodiment where the user input module 44 receives from the user the desired numerical value of the volume of water to be delivered through the discharge outlet 24 of the fitting 10 or the faucet 12, the user input module 44 can provide the user with an option to "Dispense water immediately?" (see FIG. 4*a*).

If the user selects the option to dispense water immediately, the user input module 44 sends a signal to the processor 50 indicating the desired volume should be delivered immediately upon receipt of the desired volume of water (e.g., upon selection of the preset or input of the desired volume). The processor 50 receives the signal from the user input module 44 and sends a signal to the electronic valve 32 to activate and deliver the desired volume. As a result, the fitting 10 or the faucet 12 will start delivering the desired volume of water immediately upon receipt of the desired volume of water.

Figure 5A:
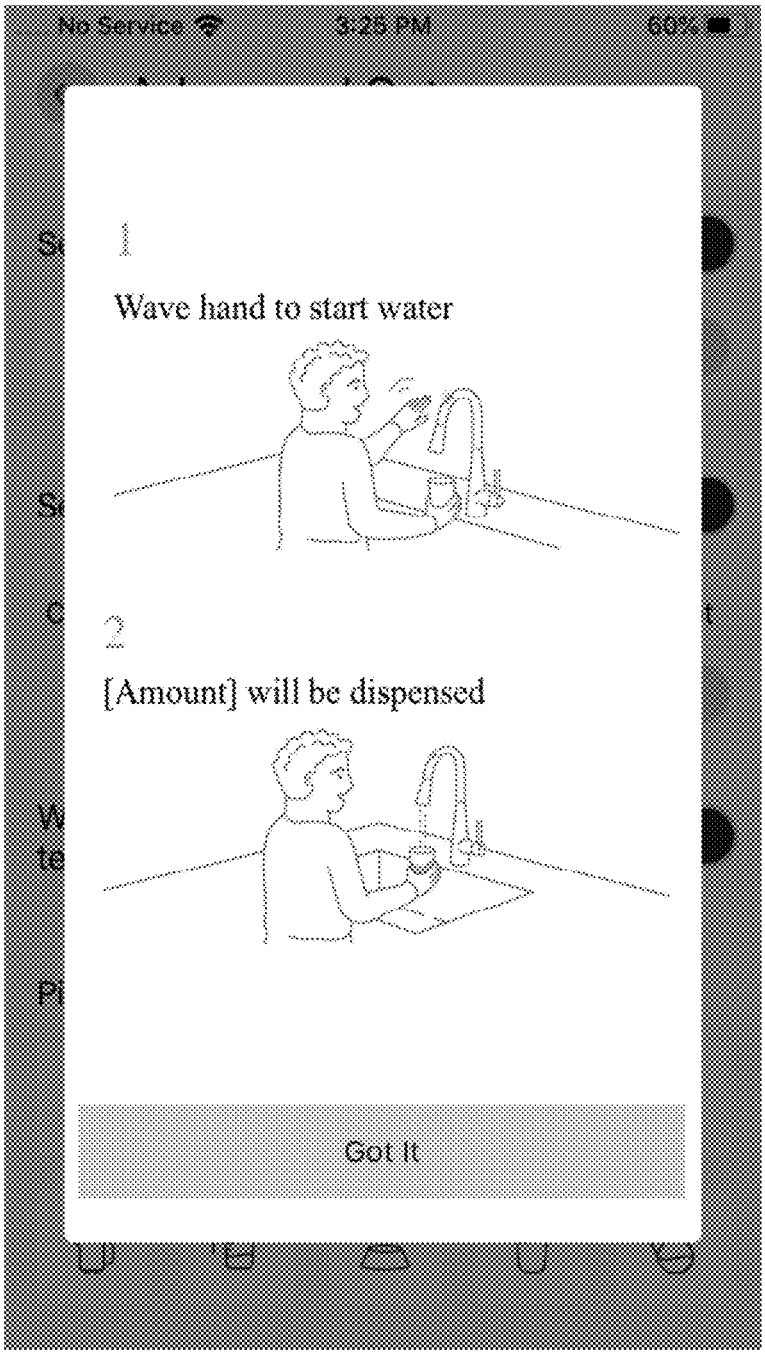
Figure 5B:
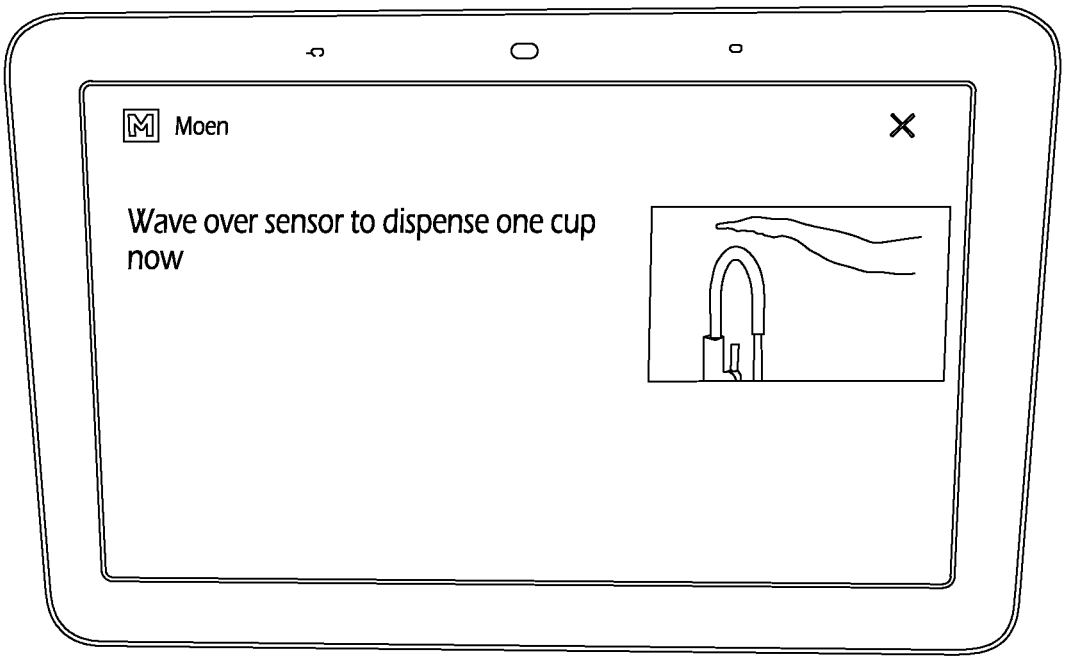

If the user does not select the option to dispense water immediately or the user is not given the option to dispense water immediately, the user input module 44 instructs the user to trigger the activation sensor 38 when they are ready for the desired volume to be delivered. For example, the user input module 44 displays or speaks a message such as the following to the user: "Wave hand to start water" and "[the desired volume] will be dispensed" (see FIG. 5*a*) or "Wave over sensor to dispense [the desired volume] now" (see FIG. 5*b*). The activation sensor 38 is triggered by the user. The activation sensor 38 sends a signal to the processor 50 indicating the desired volume should be delivered now. The processor 50 receives the signal from the activation sensor 38 and sends a signal to the electronic valve 32 to activate and deliver the desired volume. As a result, the fitting 10 or the faucet 12 will start delivering the desired volume of water at that time.

The electronic valve 32 receives the signal from the processor 50 to activate and deliver the desired volume of water. The electronic valve 32 opens and starts delivering water at an initial low flow rate. The electronic valve 32 gradually increases the flow rate at which water is delivered until the electronic valve 32 is delivering water at a full flow rate. As the desired volume is approached, the electronic valve gradually decreases the flow rate at which water is delivered until the electronic valve 32 is delivering water at a final low flow rate. Once the electronic valve 32 has delivered approximately the desired volume, the electronic valve 32 closes.

In an exemplary embodiment, the initial low flow rate is approximately 20% of the full flow rate. In an exemplary embodiment, the flow rate is increased in approximately 20% increments until the flow rate reaches approximately the full flow rate. In an exemplary embodiment, the flow rate is decreased from the full flow rate in approximately 20% decrements. In an exemplary embodiment, the final low flow rate is approximately 20% of the full flow rate.

In an exemplary embodiment, the electronic valve 32 delivers water at the initial low flow rate and each subsequent incremented flow rate for a set period of time. In an exemplary embodiment, the electronic valve 32 delivers water at the full flow rate for a variable period of time. The variable period of time is determined, in part, based on the desired volume and the full flow rate. In an exemplary embodiment, the electronic valve 32 delivers water at each decremented flow rate for a set period of time.

In an exemplary embodiment, the electronic valve 32 delivers water approximately at the following flow rates for the following periods of time:

1. 20% of a full flow rate for a first set period of time
2. 40% of the full flow rate for a second set period of time
3. 60% of the full flow rate for a third set period of time
4. 80% of the full flow rate for a fourth set period of time
5. 100% of the full flow rate for a variable period of time
6. 80% of the full flow rate for a fifth set period of time
7. 60% of the full flow rate for a sixth set period of time
8. 40% of the full flow rate for a seventh set period of time
9. 20% of the full flow rate for an eighth set period of time In an exemplary embodiment, the first, second, third, fourth, fifth, sixth, seventh, and eighth set periods of time are equal. In an exemplary embodiment, the first, second, third, fourth, fifth, sixth, seventh, and eighth set periods of time are not equal. In an exemplary embodiment, some of the first, second, third, fourth, fifth, sixth, seventh, and eighth set periods of time are equal, and some of the first, second, third, fourth, fifth, sixth, seventh, and eighth set periods of time are not equal. In an exemplary embodiment, the variable period of time is determined by calculating the volume of water delivered during the first, second, third, fourth, fifth, sixth, seventh, and eighth set periods of time, subtracting the calculated volume of water from the desired volume of water, and calculating the period of time needed to deliver the remaining volume of water at the full flow rate.

In an exemplary embodiment, with the fitting 10 or the faucet 12 having a full flow rate of 1.5 gallons per minute (GPM) and a desired volume of water to be delivered of 0.5 gallon, the electronic valve 32 delivers the water approximately as follows:

1. 0.0025 gallons at 0.3 GPM for 0.5 second
2. 0.005 gallons at 0.6 GPM for 0.5 second
3. 0.0075 gallons at 0.9 GPM for 0.5 second
4. 0.01 gallons at 1.2 GPM for 0.5 second
5. 0.45 gallons at 1.5 GPM for 0.3 seconds
6. 0.01 gallons at 1.2 GPM for 0.5 second
7. 0.0075 gallons at 0.9 GPM for 0.5 second
8. 0.005 gallons at 0.6 GPM for 0.5 second
9. 0.0025 gallons at 0.3 GPM for 0.5 second

Embodiment 2—Measured Volume—Specified Temperature

In an exemplary embodiment for delivering a volume of water at a specified temperature, the user input module 44 receives from the user desired numerical values of the volume of water to be delivered and the temperature at which the water should be delivered through the discharge outlet 24 of the fitting 10 or the faucet 12. The user can input the desired numerical values of the volume and temperature of water to be delivered by selecting a previously saved preset or by entering the desired numerical values via a voice command or another input device. The user input module 44 sends a signal to the processor 50 indicating the desired volume and temperature. The processor 50 receives the signal from the user input module 44.

FIG. 6*a* shows an exemplary screen displayed by the user input module 44 (i.e., the mobile device 66) where the user is creating a preset with a desired numerical value of the volume and a desired numerical value of the temperature.

Figure 6B:
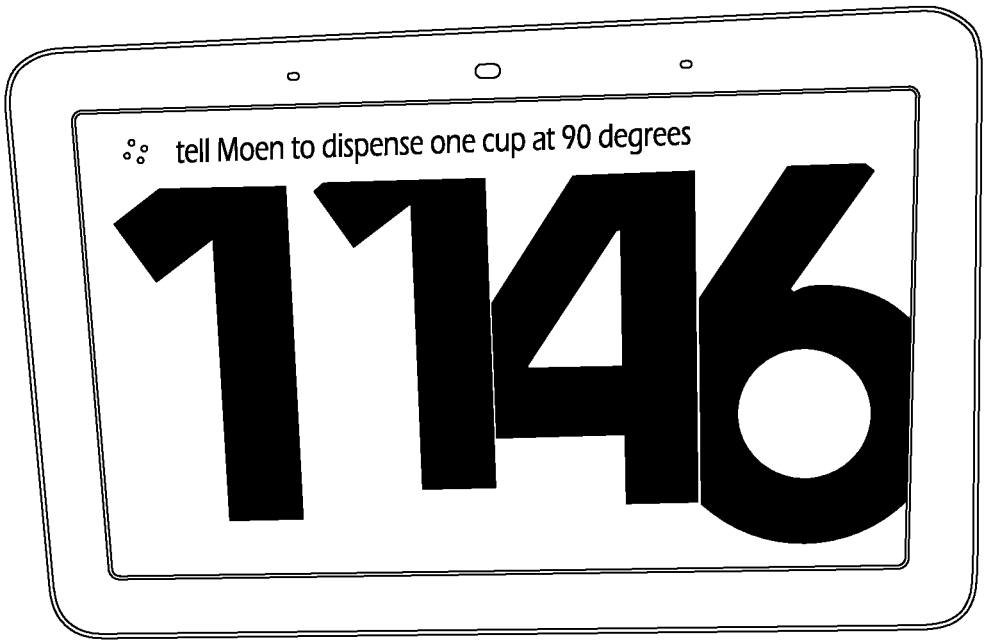

FIG. 6*b* shows an exemplary screen displayed by the user input module 44 (i.e., the voice controlled device 68) where the user has provided a desired numerical value of the volume and a desired numerical value of the temperature (the time of day is displayed with the desired numerical value of the volume and the desired numerical value of the temperature).

In the exemplary embodiment where the user input module 44 receives from the user the desired numerical value of the volume and the desired numerical value of the temperature of water to be delivered through the discharge outlet 24 of the fitting 10 or the faucet 12, the user input module 44 can provide the user with an option to "Wait to reach temperature?" (see FIG. 6*a*).

Figure 7A:
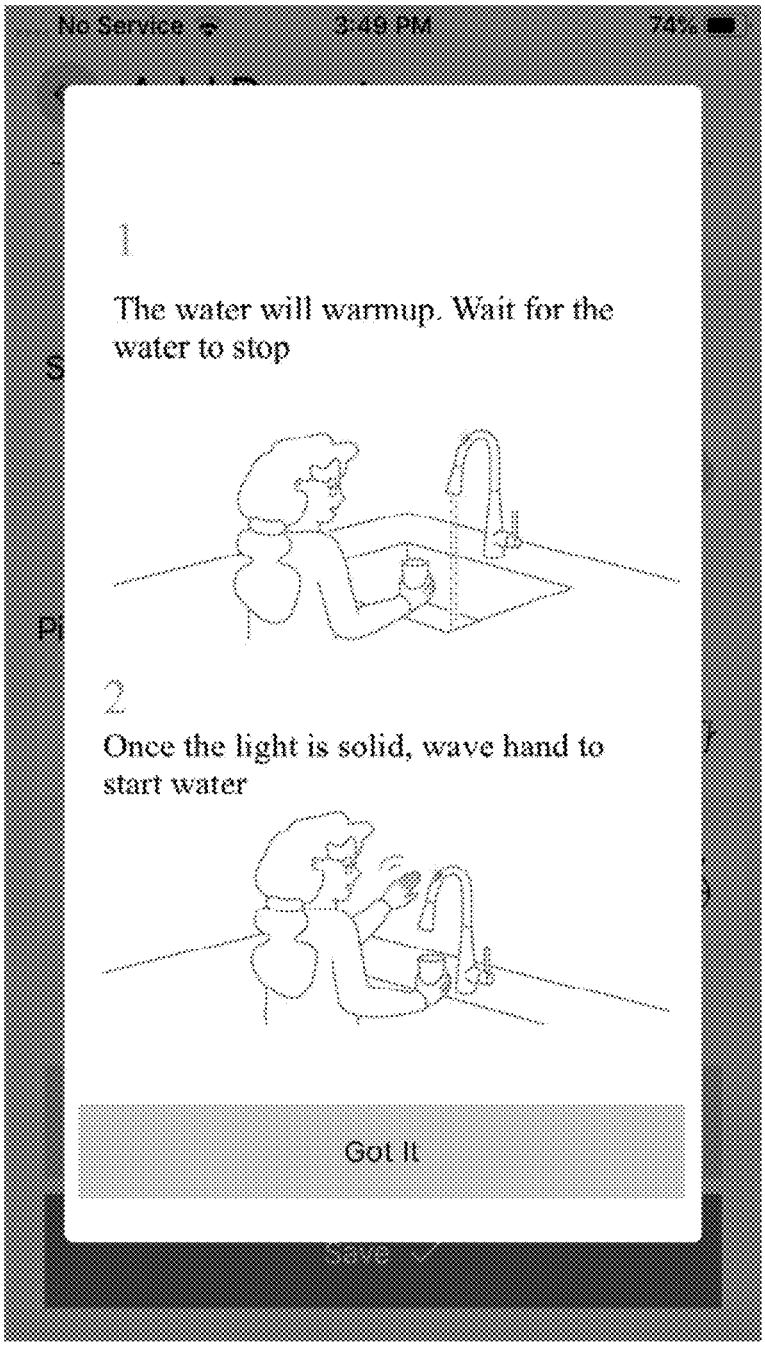
Figure 7B:
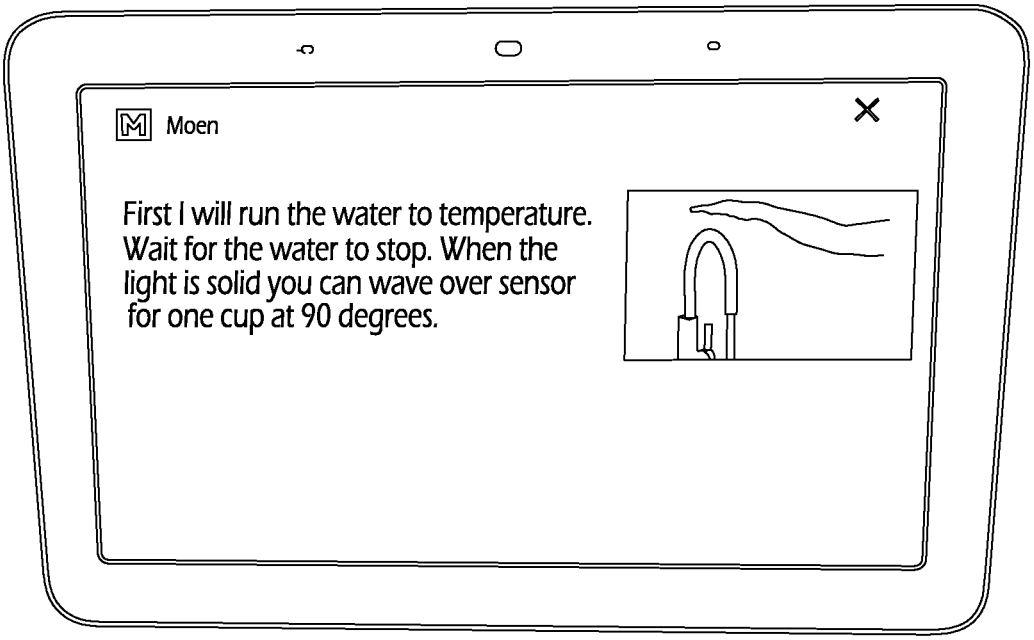

If the user selects the option to wait to reach temperature or the option to wait to reach temperature is automatically selected, the user input module 44 sends a signal to the processor 50 indicating water should be delivered until the temperature of the water reaches approximately the desired temperature. Once the water reaches approximately the desired temperature, the water is stopped, a notification is provided to the user, and the user input module 44 instructs the user to trigger the activation sensor 38 when they are ready for the desired volume at the desired temperature to be delivered. For example, the user input module 44 displays or speaks a message such as the following to the user: "The water will warmup. Wait for the water to stop" and "Once the light is solid, wave hand to start water" (see FIG. 7*a*) or "First I will run the water to temperature. Wait for the water to stop. When the light is solid you can wave over sensor for [the desired volume] at [the desired temperature]." (see FIG. 7*b*). The notification can be visual (e.g., an illuminated LED) or audible (e.g., a tone or a beep). The activation sensor 38 is triggered by the user. The activation sensor 38 sends a signal to the processor 50 indicating the desired volume at the desired temperature should be delivered now. The processor 50 receives the signal from the activation sensor 38 and sends a signal to the electronic valve 32 to activate and deliver the desired volume at the desired temperature. As a result, the fitting 10 or the faucet 12 will start delivering the desired volume at approximately the desired temperature of water once the water has warmed up.

If the user does not select the option to wait to reach temperature, the user input module 44 can provide the user with the option to "Dispense water immediately?" (see FIG. 8*a*).

If the user selects the option to dispense water immediately, the user input module 44 sends a signal to the processor 50 indicating the desired volume should be delivered immediately upon receipt of the desired volume and the desired temperature of water (e.g., upon selection of the preset or input of the desired volume and the desired temperature). The water will be delivered at whatever temperature of water is available, but the temperature of the water should be brought to the desired temperature as quickly as possible. The processor 50 receives the signal from the user input module 44 and sends a signal to the electronic valve 32 to activate and deliver the desired volume. As a result, the fitting 10 or the faucet 12 will start delivering the desired volume of water immediately, but will bring the temperature of the water to the desired temperature as quickly as possible.

If the user does not select the option to dispense water immediately (see FIG. 8*a*) or the user is not given the option to dispense water immediately, the user input module 44 instructs the user to trigger the activation sensor 38 when they are ready for the desired volume to be delivered. For example, the user input module 44 displays or speaks a message such as the following to the user: "Wave hand to start water" and "[the desired volume] will be dispensed." (see FIG. 5*a*) or "Wave over sensor to dispense [the desired volume] now" (see FIG. 5*b*). The activation sensor 38 is triggered by the user. The activation sensor 38 sends a signal to the processor 50 indicating the desired volume should be delivered now. The processor 50 receives the signal from the activation sensor 38 and sends a signal to the electronic valve 32 to activate and deliver the desired volume. As a result, the fitting 10 or the faucet 12 will start delivering the desired volume of water at that time.

The electronic valve 32 receives the signal from the processor 50 to activate and deliver the desired volume and the desired temperature of water. The electronic valve 32 opens and starts delivering water at an initial low flow rate. The electronic valve 32 gradually increases the flow rate at which water is delivered until the electronic valve 32 is delivering water at a full flow rate. As the desired volume is approached, the electronic valve gradually decreases the flow rate at which water is delivered until the electronic valve 32 is delivering water at a final low flow rate. Once the electronic valve 32 has delivered approximately the desired volume, the electronic valve 32 closes.

In an exemplary embodiment, the initial low flow rate is approximately 20% of the full flow rate. In an exemplary embodiment, the flow rate is increased in approximately 20% increments until the flow rate reaches approximately the full flow rate. In an exemplary embodiment, the flow rate is decreased from the full flow rate in approximately 20% decrements. In an exemplary embodiment, the final low flow rate is approximately 20% of the full flow rate.

In an exemplary embodiment, the electronic valve 32 delivers water at the initial low flow rate and each subsequent incremented flow rate for a set period of time. In an exemplary embodiment, the electronic valve 32 delivers water at the full flow rate for a variable period of time. The variable period of time is determined, in part, based on the desired volume and the full flow rate. In an exemplary embodiment, the electronic valve 32 delivers water at each decremented flow rate for a set period of time.

In an exemplary embodiment, the electronic valve 32 delivers water approximately at the following flow rates for the following periods of time:

1. 20% of a full flow rate for a first set period of time
2. 40% of the full flow rate for a second set period of time
3. 60% of the full flow rate for a third set period of time
4. 80% of the full flow rate for a fourth set period of time
5. 100% of the full flow rate for a variable period of time
6. 80% of the full flow rate for a fifth set period of time
7. 60% of the full flow rate for a sixth set period of time
8. 40% of the full flow rate for a seventh set period of time
9. 20% of the full flow rate for an eighth set period of time In an exemplary embodiment, the first, second, third, fourth, fifth, sixth, seventh, and eighth set periods of time are equal. In an exemplary embodiment, the first, second, third, fourth, fifth, sixth, seventh, and eighth set periods of time are not equal. In an exemplary embodiment, some of the first, second, third, fourth, fifth, sixth, seventh, and eighth set periods of time are equal, and some of the first, second, third, fourth, fifth, sixth, seventh, and eighth set periods of time are not equal. In an exemplary embodiment, the variable period of time is determined by calculating the volume of water delivered during the first, second, third, fourth, fifth, sixth, seventh, and eighth set periods of time, subtracting the calculated volume of water from the desired volume of water, and calculating the period of time needed to deliver the remaining volume of water at the full flow rate.

In an exemplary embodiment, with the fitting 10 or the faucet 12 having a full flow rate of 1.5 gallons per minute (GPM) and the desired volume of water to be delivered of 0.5 gallon, the electronic valve 32 delivers the water approximately as follows:

1. 0.0025 gallons at 0.3 GPM for 0.5 second
2. 0.005 gallons at 0.6 GPM for 0.5 second
3. 0.0075 gallons at 0.9 GPM for 0.5 second
4. 0.01 gallons at 1.2 GPM for 0.5 second
5. 0.45 gallons at 1.5 GPM for 0.3 seconds
6. 0.01 gallons at 1.2 GPM for 0.5 second
7. 0.0075 gallons at 0.9 GPM for 0.5 second
8. 0.005 gallons at 0.6 GPM for 0.5 second
9. 0.0025 gallons at 0.3 GPM for 0.5 second One of ordinary skill in the art will now appreciate that the present invention provides an electronic plumbing fixture fitting, such as an electronic faucet, including a measurement system. Although the present invention has been shown and described with reference to particular embodiments, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. An electronic plumbing fixture fitting, comprising:

a discharge outlet, the discharge outlet operable to deliver water;

an electronic valve, the electronic valve operable to permit flow of water through the discharge outlet when the electronic valve is activated and to not permit flow of water through the discharge outlet when the electronic valve is deactivated, the electronic valve operable to control a volume of water flowing through the discharge outlet;

a user input module, the user input module operable to communicate with a user regarding a desired volume of water;

a flow sensor, the flow sensor operable to detect a volume of water; and a processor, the processor operable to communicate with each of the electronic valve, the user input module, and the flow sensor regarding at least one of the desired volume of water and the detected volume of water;

wherein the user input module is operable to receive the desired volume of water from the user and to send a desired volume signal to the processor indicating the desired volume of water;

wherein the processor is operable to receive the desired volume signal from the user input module indicating the desired volume of water and to send a first control signal to the electronic valve to control the volume of water;

wherein the electronic valve is operable to receive the first control signal from the processor to control the volume of water;

wherein the electronic valve is operable to open and deliver water at an initial low flow rate for a set period of time;

wherein the flow sensor is operable to detect the volume of water and to send a detected volume signal to the processor indicating the detected volume of water;

wherein the processor is operable to receive the detected volume signal from the flow sensor indicating the detected volume of water and to send a second control signal to the electronic valve to further control the volume of water;

wherein the electronic valve is operable to receive the second control signal from the processor to further control the volume of water;

wherein the electronic valve is operable to deliver water at a full flow rate for a variable period of time; and wherein the electronic valve is operable to deliver water at a final low flow rate for a set period of time and close once the detected volume of water is approximately equal to the desired volume of water.

2. The electronic plumbing fixture fitting of claim 1, wherein the user input module is operable to provide the user with an option to dispense water immediately or to dispense water upon receipt of an input from the user.

3. The electronic plumbing fixture fitting of claim 1, wherein the electronic valve is operable to deliver water at a variable flow rate after the initial low flow rate and before the final low flow rate.

4. The electronic plumbing fixture fitting of claim 1, wherein, after the electronic valve opens, the flow rate ramps up to the full flow rate; and wherein, before the electronic valve closes, the flow rate ramps down from the full flow rate.

5. The electronic plumbing fixture fitting of claim 1, wherein the variable period of time is determined, in part, based on the desired volume and the full flow rate.

6. The electronic plumbing fixture fitting of claim 1, wherein, before the electronic valve closes, the flow rate ramps down from the full flow rate; and wherein a time at which the flow rate starts to ramp down is calculated based on a time needed for the electronic valve to close or a volume at which the flow rate starts to ramp down is calculated based on a volume of water that is delivered while the electronic valve is closing.

7. The electronic plumbing fixture fitting of claim 1, wherein, after the electronic valve opens, the flow rate ramps up at a linear rate; and wherein, before the electronic valve closes, the flow rate ramps down at a linear rate.

8. An electronic plumbing fixture fitting, comprising:

a discharge outlet, the discharge outlet operable to deliver water;

an electronic valve, the electronic valve operable to permit flow of water through the discharge outlet when the electronic valve is activated and to not permit flow of water through the discharge outlet when the electronic valve is deactivated, the electronic valve operable to control a volume and a temperature of water flowing through the discharge outlet;

a user input module, the user input module operable to communicate with a user regarding a desired volume and a desired temperature of water;

a flow sensor, the flow sensor operable to detect a volume of water;

a temperature sensor, the temperature sensor operable to detect a temperature of water; and a processor, the processor operable to communicate with each of the electronic valve, the user input module, the flow sensor, and the temperature sensor regarding at least one of the desired volume of water, the detected volume of water, the desired temperature of water, and the detected temperature of water;

wherein the user input module is operable to receive the desired volume and the desired temperature of water from the user and to send a desired volume and desired temperature signal to the processor indicating the desired volume and the desired temperature of water;

wherein the processor is operable to receive the desired volume and desired temperature signal from the user input module indicating the desired volume and the desired temperature of water and to send a first control signal to the electronic valve to control the volume and the temperature of water;

wherein the electronic valve is operable to receive the first control signal from the processor to control the volume and the temperature of water;

wherein the electronic valve is operable to open and deliver water;

wherein the temperature sensor is operable to detect the temperature of water and to send a detected temperature signal to the processor indicating the detected temperature of water;

wherein the processor is operable to receive the detected temperature signal from the temperature sensor indicating the detected temperature of water and to send a second control signal to the electronic valve to further control the temperature of water;

wherein the electronic valve is operable to receive the second control signal from the processor to further control the temperature of water;

wherein the electronic valve is operable to close and the flow of water is stopped once the detected temperature of water is approximately equal to the desired temperature of water;

wherein, once the flow of water is stopped, the user input module is operable to communicate with the user regarding a desired time for delivery of the desired volume of water at the desired temperature of water;

wherein, once the user inputs the desired time for delivery of the desired volume of water at the desired temperature of water, the user input module is operable to send a desired time signal to the processor indicating the desired time for delivery of the desired volume of water at the desired temperature of water;

wherein the processor is operable to receive the desired time signal from the user input module indicating the desired time for delivery of the desired volume of water at the desired temperature of water and to send a delivery signal to the electronic valve to deliver the water;

wherein the electronic valve is operable to receive the delivery signal from the processor to deliver the water;

wherein, at the desired time, the electronic valve is operable to open and deliver the desired volume of water at the desired temperature of water; and wherein the electronic valve is operable to close once the detected volume of water is approximately equal to the desired volume of water.

9. The electronic plumbing fixture fitting of claim 8, wherein the user input module communicates with the user regarding the desired time for delivery of the water by notifying the user once the detected temperature of water is approximately equal to the desired temperature of water.

10. The electronic plumbing fixture fitting of claim 8, wherein the user input module communicates with the user regarding the desired time for delivery of the water by receiving an input from the user when the user is ready for the desired volume of water at the desired temperature of water to be delivered.

11. The electronic plumbing fixture fitting of claim 8, wherein the electronic valve includes a cold water electronic valve and a hot water electronic valve;

wherein, when the electronic valve is opened to deliver the desired volume of water at the desired temperature of water, the cold water electronic valve is opened prior to the hot water electronic valve; and wherein, when the electronic valve is closed once the detected volume of water is approximately equal to the desired volume of water, the hot water electronic valve is closed prior to the cold water electronic valve.

12. The electronic plumbing fixture fitting of claim 8, wherein, after the electronic valve opens to deliver the desired volume of water at the desired temperature of water, the electronic valve is operable to deliver water at an initial low flow rate; and wherein, before the electronic valve closes once the detected volume of water is approximately equal to the desired volume of water, the electronic valve is operable to deliver water at a final low flow rate.

13. The electronic plumbing fixture fitting of claim 8, wherein, after the electronic valve opens to deliver the desired volume of water at the desired temperature of water, the flow rate ramps up to a full flow rate;

wherein, before the electronic valve closes once the detected volume of water is approximately equal to the desired volume of water, the flow rate ramps down from the full flow rate; and wherein control of the temperature of water being delivered is stopped at approximately the same time as the flow rate ramp down is started.

14. The electronic plumbing fixture fitting of claim 8, wherein, when the electronic valve opens before the detected temperature of water is approximately equal to the desired temperature of water, the electronic valve delivers water at a flow rate that is greater than the initial low flow rate and the final low flow rate.

15. An electronic plumbing fixture fitting, comprising:

a discharge outlet, the discharge outlet operable to deliver water;

an electronic valve, the electronic valve operable to permit flow of water through the discharge outlet when the electronic valve is activated and to not permit flow of water through the discharge outlet when the electronic valve is deactivated, the electronic valve operable to control a volume and a temperature of water flowing through the discharge outlet;

a user input module, the user input module operable to communicate with a user regarding a desired volume and a desired temperature of water;

a flow sensor, the flow sensor operable to detect a volume of water;

a temperature sensor, the temperature sensor operable to detect a temperature of water; and a processor, the processor operable to communicate with each of the electronic valve, the user input module, the flow sensor, and the temperature sensor regarding at least one of the desired volume of water, the detected volume of water, the desired temperature of water, and the detected temperature of water;

wherein the user input module is operable to receive the desired volume and the desired temperature of water from the user and to send a desired volume and desired temperature signal to the processor indicating the desired volume and the desired temperature of water;

wherein the processor is operable to receive the desired volume and desired temperature signal from the user input module indicating the desired volume and the desired temperature of water and to send a first control signal to the electronic valve to control the volume and the temperature of water;

wherein the electronic valve is operable to receive the first control signal from the processor to control the volume and the temperature of water;

wherein the electronic valve is operable to open and deliver water at an initial low flow rate for a set period of time;

wherein the flow sensor is operable to detect the volume of water and to send a detected volume signal to the processor indicating the detected volume of water;

wherein the temperature sensor is operable to detect the temperature of water and to send a detected temperature signal to the processor indicating the detected temperature of water;

wherein the processor is operable to receive the detected volume signal from the flow sensor indicating the detected volume of water and the detected temperature signal from the temperature sensor indicating the detected temperature of water and to send a second control signal to the electronic valve to further control the volume and the temperature of water;

wherein the electronic valve is operable to receive the second control signal from the processor to further control the volume and the temperature of water;

wherein the electronic valve is operable to deliver water at a full flow rate for a variable period of time; and wherein the electronic valve is operable to deliver water at a final low flow rate for a set period of time and close once the detected volume of water is approximately equal to the desired volume of water.

16. The electronic plumbing fixture fitting of claim 15, wherein the user input module is operable to provide the user with an option to dispense water immediately or to dispense water once the detected temperature is approximately equal to the desired temperature and the user input module has received an input from the user when the user is ready for the desired volume of water at the desired temperature of water to be delivered.

17. The electronic plumbing fixture fitting of claim 15, wherein the user input module is operable to provide the user with an option to dispense water immediately or to dispense water upon receipt of an input from the user.

18. The electronic plumbing fixture fitting of claim 15, wherein the electronic valve is operable to deliver water at a variable flow rate after the initial low flow rate and before the final low flow rate.

19. The electronic plumbing fixture fitting of claim 15, wherein the variable period of time is determined, in part, based on the desired volume and the full flow rate.

20. The electronic plumbing fixture fitting of claim 15, wherein, after the electronic valve opens to deliver the desired volume of water at the desired temperature of water, the flow rate ramps up to the full flow rate;

wherein, before the electronic valve closes once the detected volume of water is approximately equal to the desired volume of water, the flow rate ramps down from the full flow rate; and wherein control of the temperature of water being delivered is stopped at approximately the same time as the flow rate ramp down is started.

* * * * *